US010219093B2

(12) United States Patent
Luna

(10) Patent No.: US 10,219,093 B2
(45) Date of Patent: Feb. 26, 2019

(54) MONO-SPATIAL AUDIO PROCESSING TO PROVIDE SPATIAL MESSAGING

(71) Applicant: Michael Luna, San Jose, CA (US)

(72) Inventor: Michael Luna, San Jose, CA (US)

( * ) Notice: Subject to any disclaimer, the term of this patent is extended or adjusted under 35 U.S.C. 154(b) by 229 days.

(21) Appl. No.: 13/830,770

(22) Filed: Mar. 14, 2013

(65) Prior Publication Data

US 2014/0270183 A1 Sep. 18, 2014

(51) Int. Cl.
*H04S 7/00* (2006.01)
*H04R 25/00* (2006.01)

(52) U.S. Cl.
CPC ..... *H04S 7/30* (2013.01); *H04R 25/353* (2013.01); *H04R 25/356* (2013.01); *H04S 2400/11* (2013.01); *H04S 2420/01* (2013.01)

(58) Field of Classification Search
None
See application file for complete search history.

(56) References Cited

U.S. PATENT DOCUMENTS 5,521,981 A * 5/1996 Gehring ..... 381/17
5,926,364 A * 7/1999 Karidis ..... 361/679.27
6,647,119 B1 * 11/2003 Slezak ..... 381/17
7,921,016 B2 * 4/2011 Ou ..... 704/266
2004/0196991 A1 * 10/2004 Iida et al. ..... 381/309
2005/0041816 A1 * 2/2005 Cheng ..... 381/26
2005/0213777 A1 * 9/2005 Zador et al. ..... 381/94.1
2007/0121951 A1 * 5/2007 Kim ..... 381/1
2007/0127748 A1 * 6/2007 Carlile et al. ..... 381/312
2007/0263823 A1 * 11/2007 Jalava et al. ..... 379/202.01
2009/0240497 A1 * 9/2009 Usher et al. ..... 704/235
2011/0116665 A1 * 5/2011 King et al. ..... 381/300

* cited by examiner

*Primary Examiner* — Brenda Bernardi

(57) ABSTRACT

Embodiments of the invention relate generally to electrical and electronic hardware, computer software, wired and wireless network communications, and wearable computing and audio devices for communication audio. More specifically, disclosed are an apparatus and a method for processing audio signals to include spatially modulated message audio signals as a portion of a monaural signal. In some embodiments, a method includes receiving a message for a loudspeaker. The method can determine whether an audio signal is in communication with the loudspeaker and a type of a message of the message. Message audio for the message can be spatially modulated as a function of the type of message. A mono-spatial audio signal can be formed based on the audio signal and the spatially-modulated message. Thus, a monaural audio signal can be modulated to generate mono-spatial effects for presenting the messages.

18 Claims, 9 Drawing Sheets

MONO-SPATIAL AUDIO PROCESSING TO PROVIDE SPATIAL MESSAGING

FIELD

Various embodiments relate generally to electrical and electronic hardware, computer software, wired and wireless network communications, and wearable computing and audio devices for generating and presenting audio to a user. More specifically, disclosed are an apparatus and a method for processing audio signals to include spatially-modulated message audio signals as a portion of a monaural signal.

BACKGROUND

Conventionally, known spatial audio systems generally rely on multiple speakers separated in a spatial environment or the use of stereo headsets to provide a desired spatial effect. Such effects include simulation of various locations for sources of the sound (e.g. as to distance and/or direction), such as in common home theater systems that can simulate sound positions. The sound effects enable a listener to perceive that they are surrounded by sound in the spatial environment. Typical spatial audio generation systems use multiple speakers and a minimum of a stereo source to shift and distribute sound to simulate sources in the spatial environment.

Generally, current spatial audio systems perform sound localization principally using different cues or binaural cues, which relate to the time differences in the arrival of a sound two ears (i.e., the interaural time difference, or ITD) and the intensity differences (i.e., the interaural intensity difference, or IID) between the two ears. As such sound localization techniques are directed to two ears, stereo signals (i.e., binaural signals) are typically used to provide sound localization effects. Current spatial audio is usually limited to stereo or multiple source environments since monophonic sources typically are not well-suited to employ ITD or IID. Thus, known spatial audio techniques do not usually use approaches other than binaural spatial modulation to create a reference from which to shift the sound. With the general focus on binaural and stereo signals, as well as multiple speaker systems (e.g., surround sound), conventional spatial audio generation techniques are not well-suite for certain applications.

Thus, what is needed is a solution for data capture devices, such as for wearable devices, without the limitations of conventional techniques.

BRIEF DESCRIPTION OF THE DRAWINGS

Various embodiments or examples ("examples") of the invention are disclosed in the following detailed description and the accompanying drawings.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
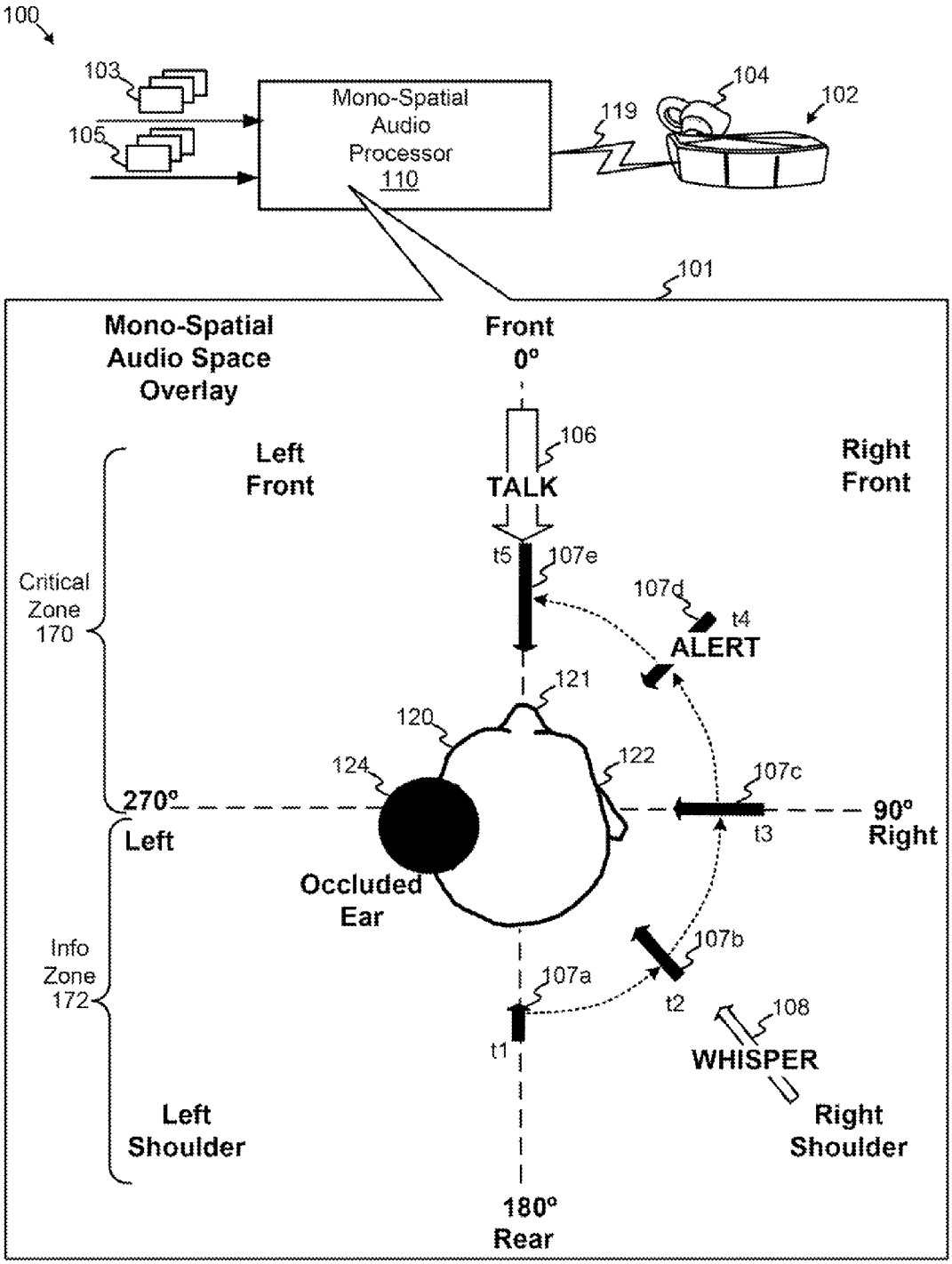
FIG. 1 illustrates an example of a mono-spatial audio processor, according to some embodiments.

FIG. 1 illustrates an example of a mono-spatial audio processor, according to some embodiments. Diagram 100 depicts a mono-spatial audio processor 110 configured to receive audio 103 and one or more messages 105 for transmission as a mono-spatial audio signal 119 to a loudspeaker, such as a loudspeaker in a wearable device. For example, wearable device 102 is a headset configured to wirelessly receive audio information for presentation via loudspeaker 104. According to various embodiments, mono-spatial audio processor 110 is configured to provide audio 103 to a user 120 via audio device 102. In the example shown, audio device 102 is configured to be a wearable audio device, by which loudspeaker 104 is located adjacent ear 122, or at or within an ear canal associated with ear 122. Since audio device 102 and corresponding loudspeaker 104 present audio 103 to ear 122, audio 103 is not received into the other ear. As such, that other ear can be represented as an "occluded ear" 124.

Further, mono-spatial audio process 110 is configured to generate a mono-spatial audio space overlay 101 on top of, or in association with, the presentation of audio 103 to user 120. For example, mono-spatial audio processor 110 can be configured to implement mono-spatial audio space overlay 101 as an alerting environment in which different messages 105 can be perceived by user 120 as originating at different perceived locations, directions, or distances from 120. Therefore, user 120 can receive mono-spatial audio signals from mono-spatial audio processor 110 that can be used to simulate real-world notifications with a monaural audio signal.

Mono-spatial audio processor 110 can be configured to determine which of messages 105 are to be modulated to be perceived as critical messages 106 or informational messages 108. For example, mono-spatial audio processor 110 can configure critical messages ("TALK") 106 to be perceived as originating from or in a direction within critical zone 170. For example, a critical message 106 can be presented via loudspeaker 104 into ear 122, whereby critical message 106 is perceived as being issued from directly in front of user 120 to simulate an urgent need of attention, as if someone were directly in front of user 120, demanding attention or their immediate response. In some examples, critical message 106 can be implemented as primary message audio. As shown, critical message 106 is depicted as being perceived from originating in the direction at 0° relative to the nose of user 120. Nose 121 can be used as a reference point with which to describe the direction of incoming spatially-modulated message audio signals. Critical zone 170 can be used to present messages to user 120 that are of greater relevance or of primary focus, and can extend, for example, from 90° to 270° relative to reference point 121, but such a range need not be so limiting. Critical messages 106 can displace primary audio, such as audio during a telephone call or the playback of music, or can be mixed with the primary audio.

As another example, mono-spatial audio processor 110 can configure informational messages 108 to be perceived as originating from or in the direction from information zone 172. For example, an informational message ("WHISPER") 108 can be presented via loudspeaker 104 into ear 122, whereby information message 108 is perceived as being issued from behind user 120. As shown, informational message 108 can be perceived as originating over the right shoulder of user 120 to convey, for example, a low battery warning, an upcoming scheduled date or time, or any other less urgent messages. In some examples, informational messages 108 can be perceived by user 120 without interfering with the presentation of primary audio that may be received by user 120, for example, from the direction of 0°. In some examples, informational message 108 can be implemented as secondary message audio. Information zone 172 is depicted as ranging from 90° to 270° as but one example. Thus, information zone 172 is not intended to be limited to such a range, but rather can include any range of directions or locations.

In yet another example, mono-spatial audio processor 110 can be configured to present a subset of messages 105 as alert messages 107. As shown in diagram 100, alert messages 107 are generated by mono-spatial audio processor 110 to be perceived as originating from different spatial locations or directions or distances over different periods of time. For example, mono-spatial audio processor 110 can identify that a message 105 is an alert message 107. At time, T1, alert message 107*a* is generated by mono-spatial audio processor 110 to be perceived as originating from directly behind user 120 with, for example, relatively low volume. As time progresses and as the urgency increases (or some other variable changes) for alert message 107, alert message 107 is configured to be perceived by user 120 as progressively moving locations from behind user 120 (i.e., as alert message 107*a*) at time T1, to another location at which message 107*e* is generated. Thus, alert message 107 presented to user 120 at different times as alert message 107*b*, alert message 107C, alert message 107D, or alert message 107*e*. As depicted, the volume of alert message 107 can progressively increase as alert message 107 transitions from alert message 107*a* to alert message 107*e*. Alert message 107, therefore, can be used by mono-spatial audio processor 110 to provide perceived sound movement using monaural signals for user 120.

In view of the foregoing, mono-spatial audio processor 110 is configured to generate spatially discernible audio effects using a monaural audio signal and/or a single speaker 104 in an earpiece for an audio device 102. In accordance with various structures and/or functionalities of mono-spatial audio processor 110, a spatial user interface can be generated to provide for mono-spatial audio space overlay 101 in association with audio presented to user 120 or when audio is not being presented to user 120. Thus, mono-spatial audio processor 110 and/or one or more applications that include executable instructions can be configured to provide an alerting or notification system that is distributed in the user's perceived audio space by using a spatially-modulated message audio signal. Therefore, mono-spatial audio processor 110 can provide the user 120 using a single loudspeaker 104 with spatial effects, which need not require the use, for example, of binaural or stereo signals. Further, mono-spatial audio processor 110 can enable user 120, who is deaf, or partially deaf, in one ear (i.e., occluded ear 124), with an ability to perceive spatially-presented audio.

Figure 2:
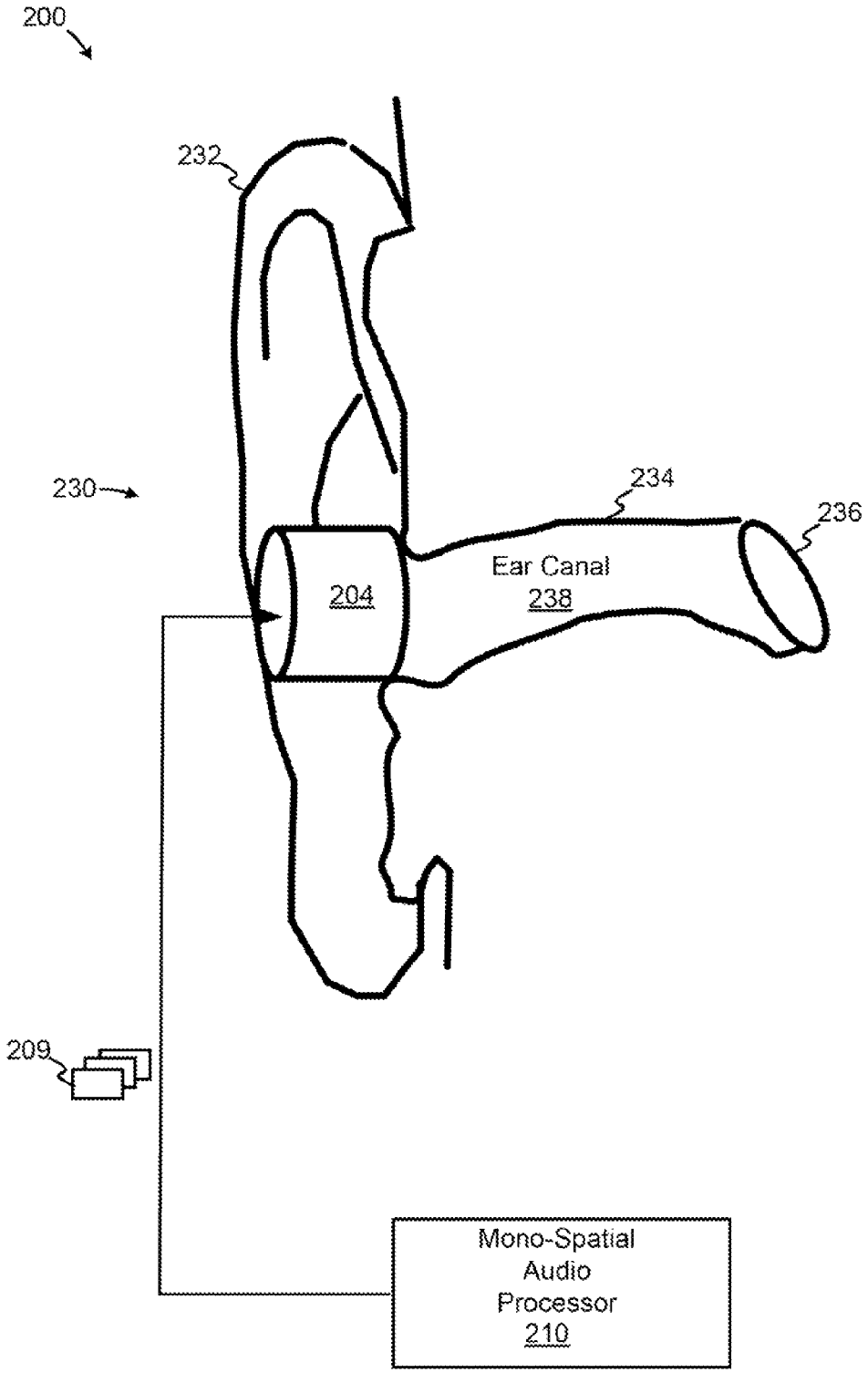
FIG. 2 depicts a diagram of an example of a mono-spatial audio processor, according to some embodiments.

FIG. 2 depicts a diagram of an example of a mono-spatial audio processor, according to some embodiments. Diagram 200 depicts mono-spatial audio processor 210 being configured to transmit mono-spatial audio signals 209 to speaker 204, which is located at, near, or in ear canal 238 of ear 230. In the example shown, ear canal 238 is a cavity or space defined by the dimensions and boundaries of ear canal walls 234, ear drum 236, and speaker 204. The space of ear canal 238 provides a spatial place or environment in which audio signals can be modulated to create a spatially discernible effect relative to the active eardrum 236. In particular, message-related audio can be phase-shifted, frequency-shifted, and/or volume-shifted relative to eardrum 236 to produce monaurally-created spatial effects.

Mono-spatial audio processor 210 is configured to modulate audio signals for messages in accordance to the effects, for example, of pinna 232 of ear 230, as well as the effects of ear canal 238. Pinna 232 can be modeled in terms of its functionality. In particular, pinna 232 operates differently for high and low frequency sounds and behaves as a filter that is direction-dependent. Pinna 232 also can be modeled by delays that it introduces when sound waves enter ear canal 238. The structures of ear 230 can be characterized and, therefore, modeled based on modulation parameters. According to some embodiments, the modulation parameters can be determined for different types of messages. Some examples of modulation parameters include a value for a phase-shift, a value for a frequency-shift, and/or a value for a volume-shift, among others. Mono-spatial audio processor 210 uses the modulation parameters to modulate the audio for the different types of messages to create the mono-spatial effects for the messages described herein. That is, mono-spatial audio processor 210 can be configured to modulate spatially a message audio signal for a specific type of message to form a spatially-modulated message audio signal, whereby different modulation parameters are applied to the message audio signal as a function of the different types of messages. In at least some examples, the term "spatially-modulated message audio signal" can refer to an audio signal including message data that is modulated in accordance with modulation parameters to create the mono-spatial effects so that a user can perceive different locations for the source of the messages.

A mono-spatial audio processor can be configured to identify a primary message type associated with a message, and select a first subset of modulation parameters to form a spatially-modulated message audio signal that is associated with a first direction, such as between 0° and 45° relative to a reference point. However, the primary message can originate, or be perceived to originate, from any direction. Further, a secondary message type can be identified for a message, whereby the mono-spatial audio processor can be configured to select a second subset of modulation parameters that are configured to form a spatially-modulated message audio signal in a second direction. Also, mono-spatial audio processor can be configured to identify an alert message type for a message and select a third subset of modulation parameters that are specifically configured to form spatially-modulated audio signals associated with multiple directions over multiple intervals of time.

Figure 3:
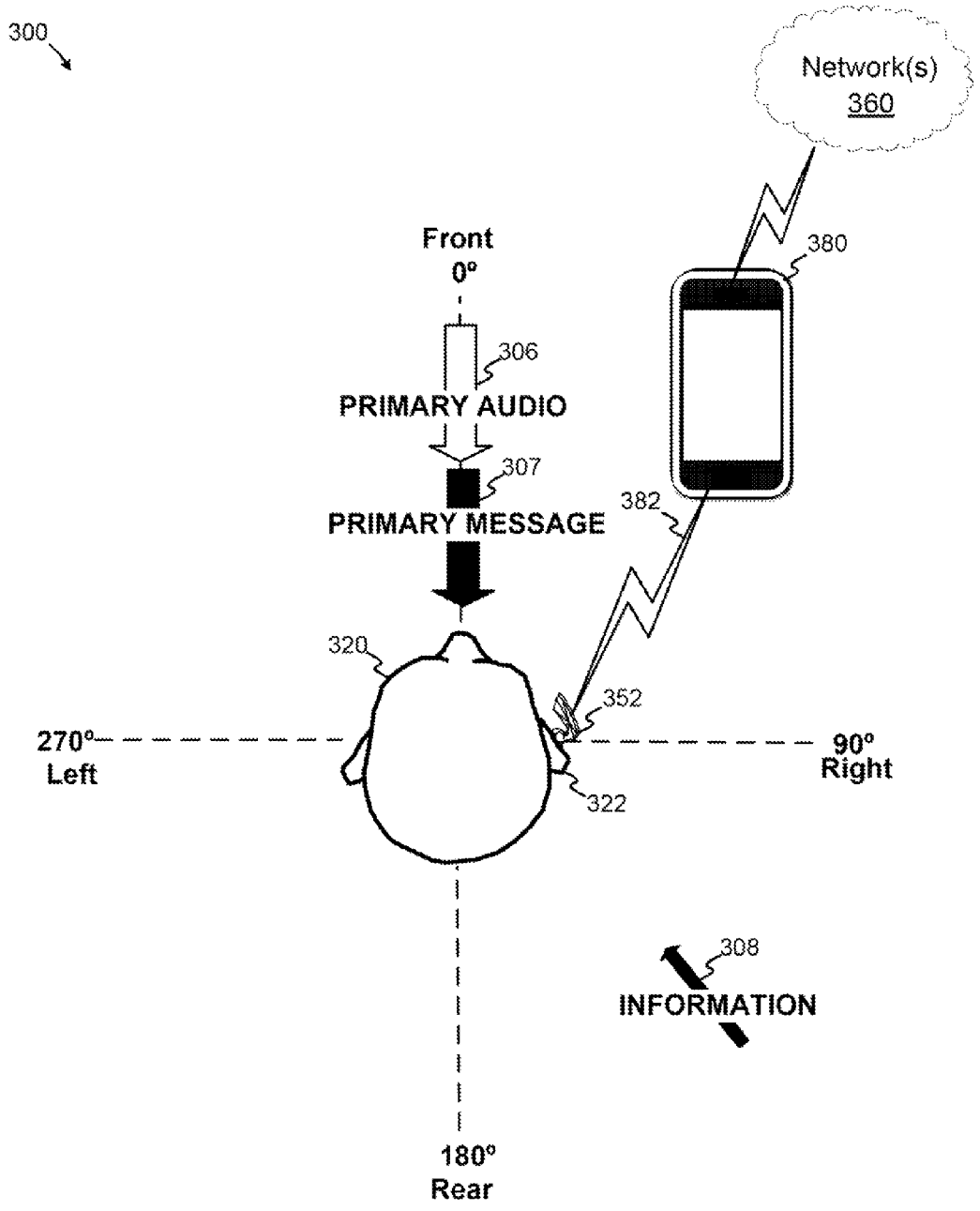
FIG. 3 depicts an example of mono-spatial messaging when a user is consuming audio, according to some embodiments.

FIG. 3 depicts an example of mono-spatial messaging when a user is consuming audio, according to some embodiments. Diagram 300 depicts a user 320 using an audio device 352 with which to receive audio into the user's ear 322. In this example, user 320 is receiving primary audio 306, such as audio from a telephone conversation, which originates remotely over a network 360 (e.g., a telephony, IP, wireless, etc. network). A mobile communication device 380 or any other computing device can be configured to convey primary audio 306 from network 360 to audio device 352 via electronic communications path 382. In this example, a mono-spatial audio processor can be implemented in mobile computing device 380, in audio device 352, or in any other device. When a message is generated, by, for example, a calendar application in mobile computing device 380, the mono-spatial audio processor in mobile computing device 380 can generate either a primary message 307 of critical importance or an informational message 308 of contextual relevancy.

According to some embodiments, mono-spatial audio processor 110 can be configured receive data representing a message to present as audio via a loudspeaker. Further, to this example, the mono-spatial audio processor can be configured to determine whether an audio signal, such as primary audio, is in communication with the loudspeaker (e.g., the audio is playing for the user via the loudspeaker). If so, the mono-spatial audio processor can determine the type of message associated with a particular message and spatially modulate that message as a function of the type of message to form a spatially modulated message audio signal. The mono-spatial audio processor can form a mono-spatial audio signal, for example, based on the primary audio signal, as a reference signal, and the spatially-modulated message. In various embodiments, primary message 306 can be combined (e.g., mixed) with the primary audio that user 320 is consuming to form a mono-spatial audio signal. Note that, however, a mono-spatial audio signal need not include a mix of a primary message 306 and a primary audio signal 306. For example, primary message 306 can be transmitted in place of the primary audio to user 320, whereby the primary audio signal is interrupted by primary message 306 temporarily. In some instances, primary messages 306 can be interleaved in time with primary audio signal 306.

Figure 4:
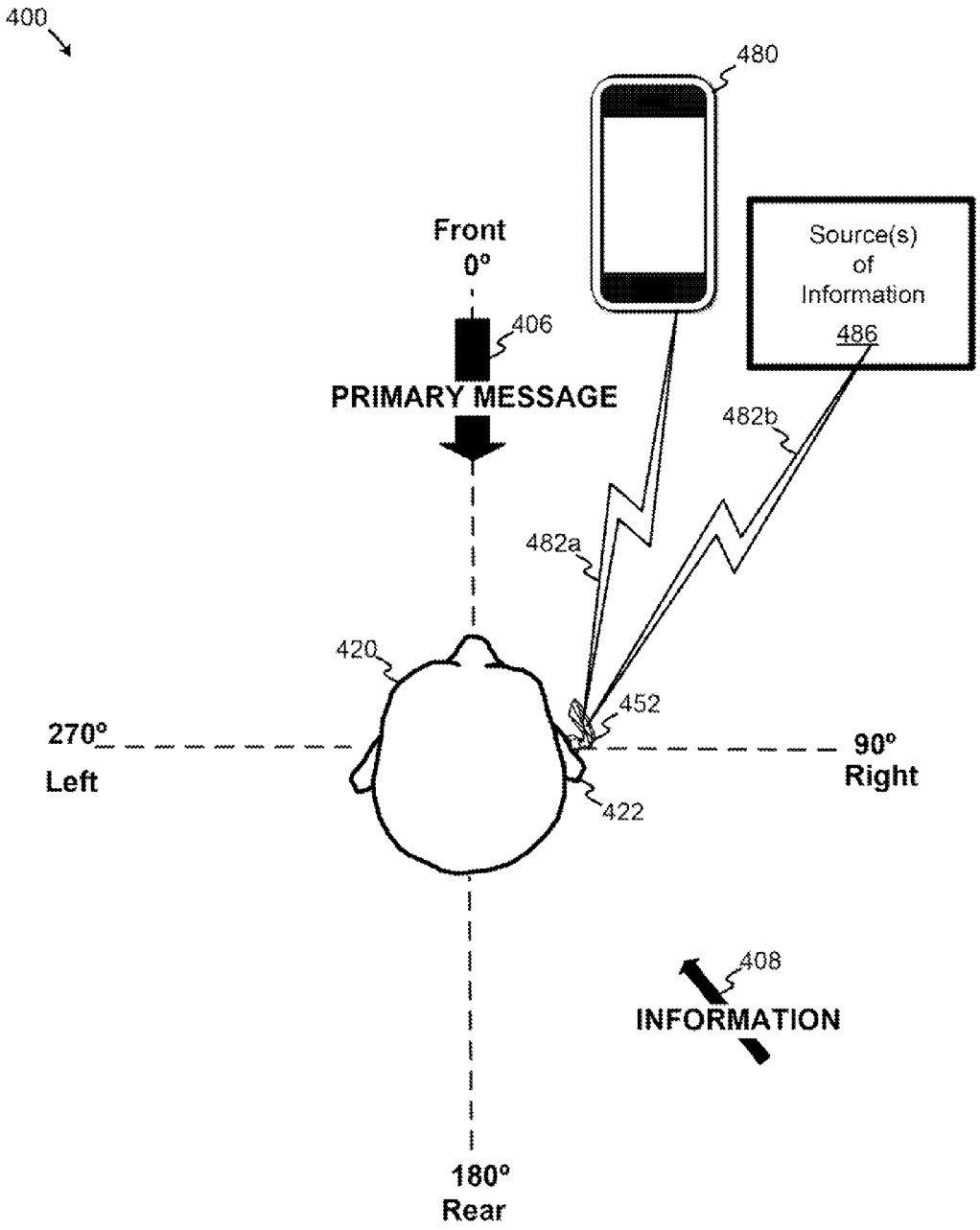
FIG. 4 depicts an example of mono-spatial messaging when a user is not consuming other audio, according to some embodiments.

FIG. 4 depicts an example of mono-spatial messaging when a user is not consuming other audio, according to some embodiments. Diagram 400 depicts a user 420 using an audio device 452 with which to receive audio into the user's ear 422, the audio originating from, for example, mobile computing device 480 or any other source of information 486. In this example, a mono-spatial audio processor (not shown) is configured to detect the absence of any primary audio, such as the absence of an audio signal used for the presentation of music, to user 420 via audio device 452. The mono-spatial audio processor is configured to generate a reference signal or background signal, responsive to the lack of primary audio, whereby the reference signal can serve as a baseline audio signal with which to modulate with message-related audio. In some examples, the reference signal is a form of white noise that can be modulated in accordance with modulation parameters based on a type of message. Therefore, a primary message 406 can be generated using the reference signal for critical messages, whereas an informational message 408 can be generated using the reference signal for contextually-relevant, but non-critical information.

According to some embodiments, mono-spatial audio processor 110 can be configured receive data representing a message to present as audio via a loudspeaker. Further to this example, the mono-spatial audio processor can be configured to determine whether an audio signal, such as a primary audio, is in communication with the loudspeaker. If not (i.e., no audio signals in communication with the loudspeaker), the mono-spatial audio processor can generate or otherwise use a reference audio signal, such as a low frequency white noise signal, when no external audio sources available. In some cases, this allows for phase and frequency shifting on a sound for a message to be positioned in the spatial environment relative to a reference, which can be the white noise signal. Once a message type is identified, the audio signal of the message can be spatially modulated as a function of the type of message using, for example, a white noise signal. A mono-spatial audio signal then can be generated and transmitted to an audio device, such as a Bluetooth® headset, for presenting the message acoustically to the user 420, whereby the user can perceive a direction in the mono-spatial environment.

Figure 5:
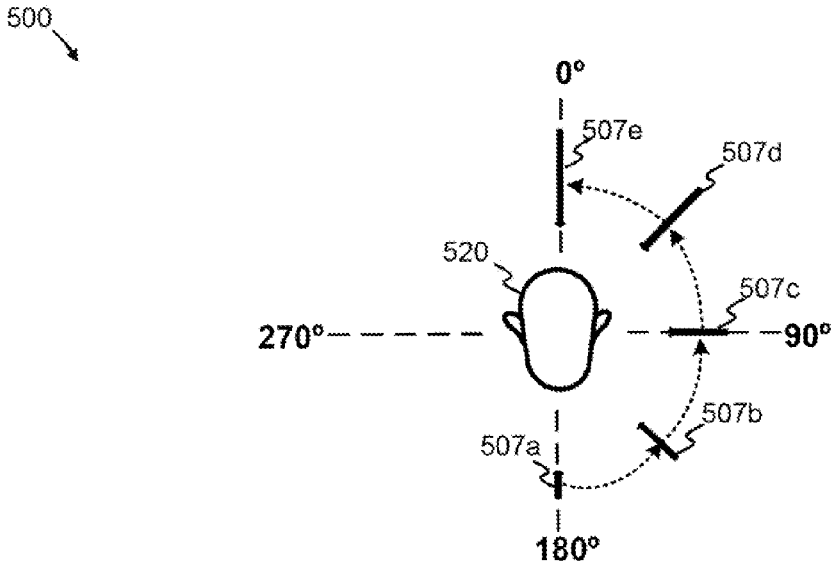
FIG. 5 is a diagram depicting other spatial effects, according to some embodiments.

FIG. 5 is a diagram depicting other spatial effects, according to some embodiments. While examples of a mono-spatial audio processor have been described above as providing different spatial effects in an azimuthal plane, various embodiments are not so limited. For example, mono-spatial audio processor can be configured to generate spatial effects at different elevations. In particular, a mono-spatial audio processor can generate mono-spatial messages that are perceived by user 520 is originating from any of the depicted locations. Thus, user 520 can perceive that message 507*a* to message 507*e* originating at different elevations. For example, message 507*a* can be perceived as originating from a location near the feet of user 520, whereas message 507*e* can be perceived as being generated at a location above the head of user 520. In other examples, the mono-spatial audio processor can generate messages that can be perceived as originating anywhere in space.

Figure 6:
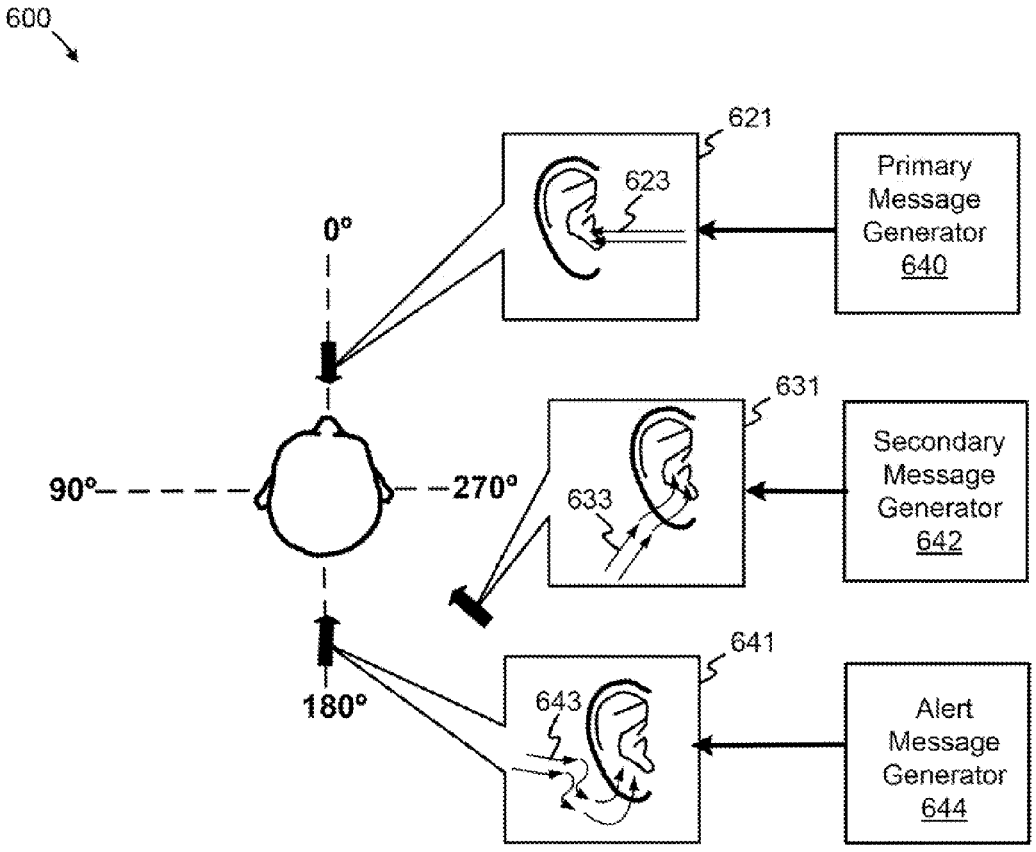
FIG. 6 is a diagram depicting examples of generators for various spatial effects, according to some embodiments.

FIG. 6 is a diagram depicting examples of generators for various spatial effects, according to some embodiments. Diagram 600 includes a primary message generator 640, a secondary message generator 642, and an alert message generator 644. As shown, primary message generator 640 is configured to use modulation parameters to spatially modulate audio for a message, such that the mono-spatial audio signal is perceived by the user as being received naturally as audio 623 (i.e., the user perceives the audio as originating directly in front of the user). Secondary message generator 642 is configured to spatially modulate audio for a message, such that the mono-spatial audio signal is perceived by the user as being received naturally as audio 633 (i.e., the user perceives the audio as originating over the right-hand shoulder of the user). Alert message generator 640 is configured to spatially modulate audio for a message, such that the mono-spatial audio signal is perceived by the user as being received naturally as audio 643 (i.e., the user perceives the audio as originating behind the user, as well as from different directions).

Figure 7:
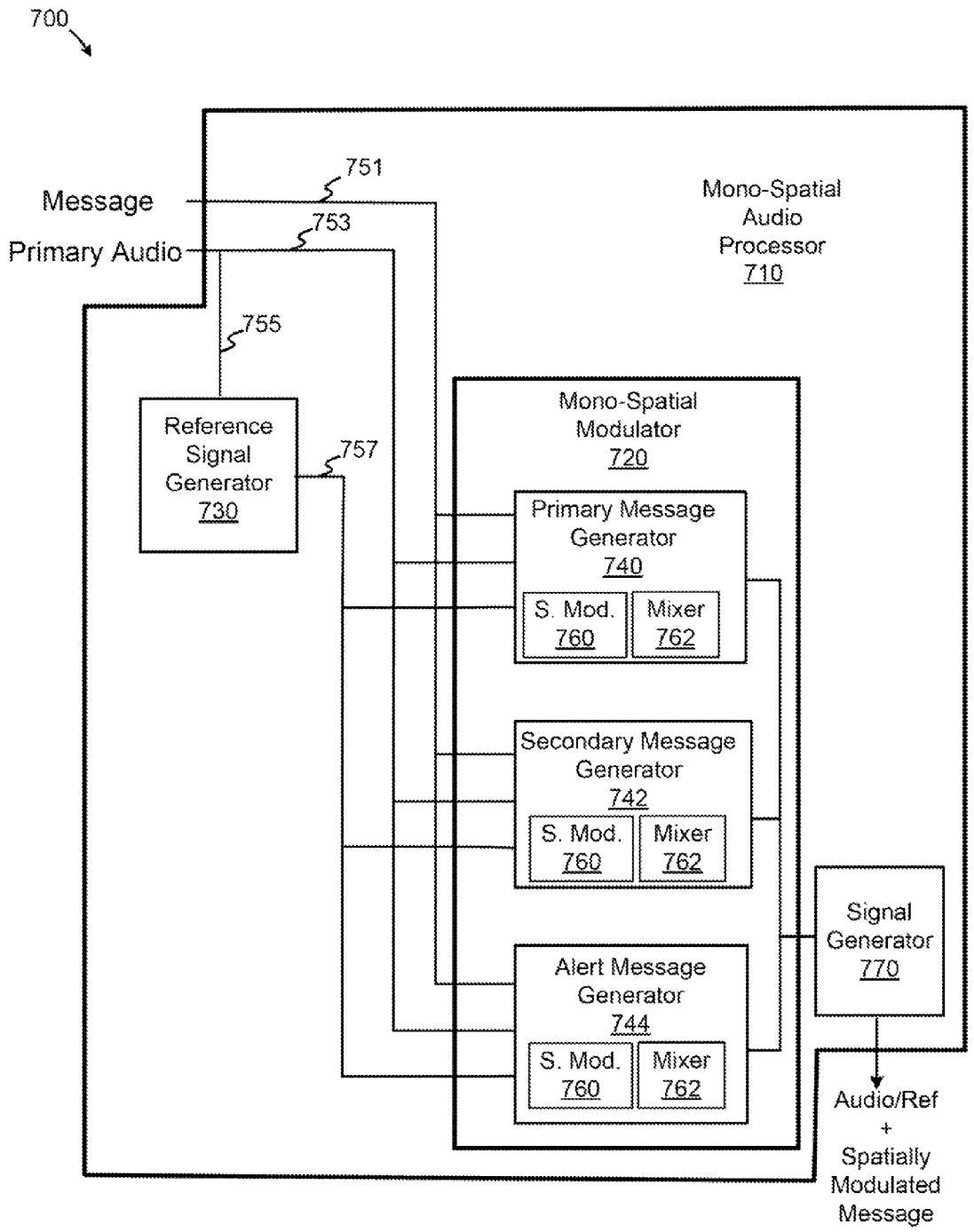
FIG. 7 depicts a functional block diagram of a mono-spatial audio processor, according to some embodiments.

FIG. 7 depicts a functional block diagram of a mono-spatial audio processor, according to some embodiments. Mono-spatial spatial audio processor 710 is configured to receive a message via path 751 and a primary audio via path 753. Mono-spatial audio processor 710 also includes a reference signal generator 730 and a mono-spatial modulator 720. Reference signal generator 730 is configured to receive primary audio via path 755, and if no primary audio is present, reference signal generator 730 generates a reference signal, such as white noise, for transmission via path 757 to mono-spatial modulator 720. Mono-spatial monitor 720 includes a primary message generator 740, a secondary message generator 742, and an alert message generator 744, one or more of which can have similar structures and/or functionalities as similarly-named elements of FIG. 6. In at least some examples, each of primary message generator 740, secondary message generator 742, and alert message generator 744 can include a spatial modulator ("S. Mod.") 760 and or a mixer 762. Spatial modulator 760 is configured to receive modulation parameters and perform spatial modulation of at least the audio of the message. In some cases, the spatially modulated message audio may be mixed with a primary audio. However, audio mixing is not required. Each of primary message generator 740, secondary message generator 742, and alert message generator 744 can receive control data (not shown) via paths 751 indicating which type of message is associated with the message audio to be transmitted. As such, mono-spatial modulator 720 can select an appropriate generator 740, 742, or 744 responsive to the control data and type of message. Mono-spatial modulator 720 generates an output for signal generator 770, which is configured to amplify and otherwise condition the signal for transmission to include either a spatially modulated message or a primary audio signal for consumption by the user, or both.

Figure 8:
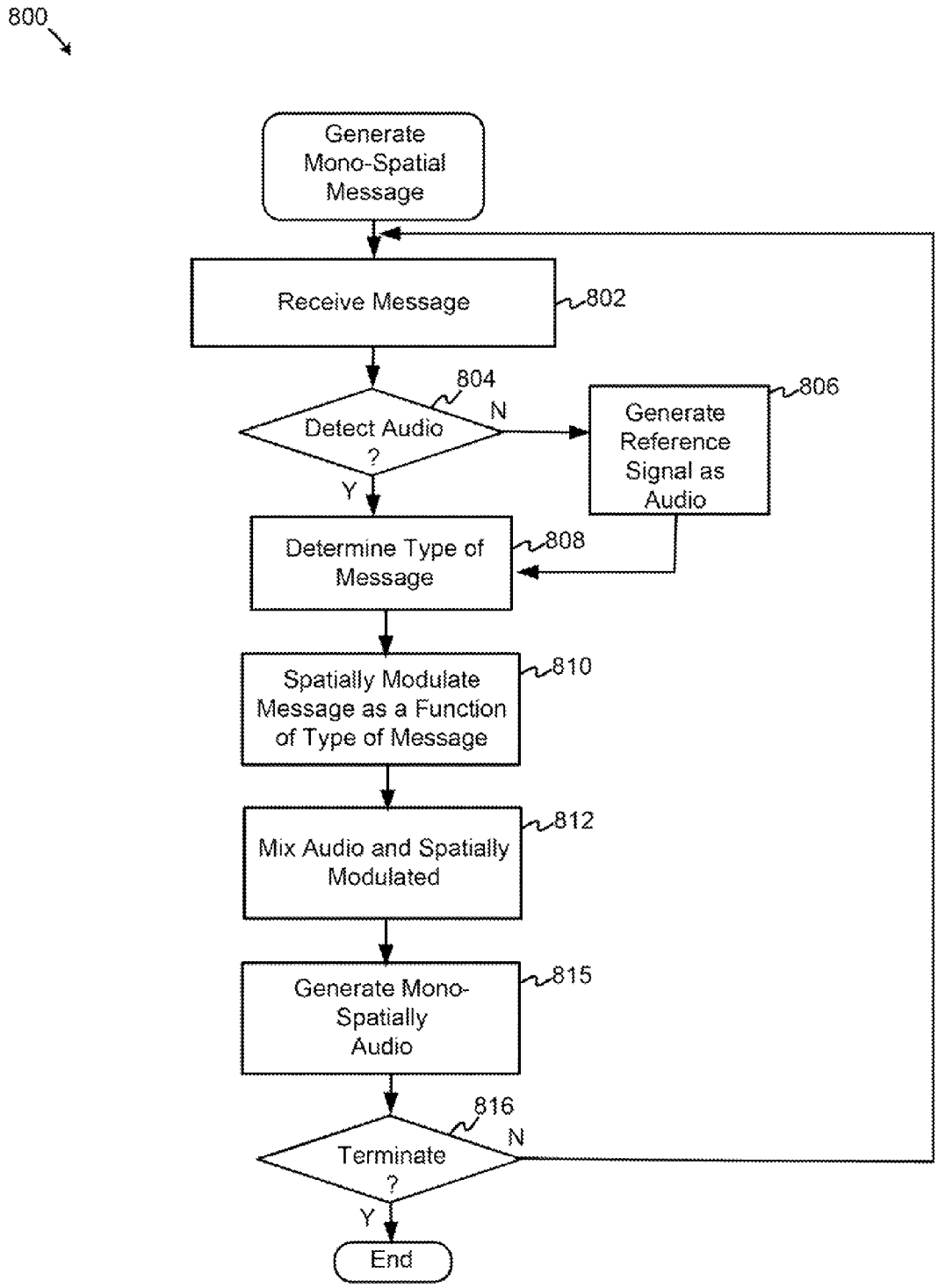
FIG. 8 is an example flow diagram for generating mono-spatial messages according to some embodiments.

FIG. 8 is an example flow diagram for generating mono-spatial messages according to some embodiments. At 802, a message is received. At 804, a determination is made whether audio is detected. If not, flow 800 moves to 806 at which a reference signal is generated as the audio. Otherwise, flow 800 moves to 808 to determine the type of message. At 810, a message is spatially modulated as a function of the type of message. For example, critical messages are modulated to be perceived as originating from a relatively frontal position, whereas informational messages can be modulated to be perceived as, for example, "a whisper" over a right shoulder at reduced volume. Optionally, primary audio to be consumed by the user in a spatially modulated message may be mixed 812, but such mixing need not be required. At 815, a mono-spatial audio signal is generated for transmission to a loudspeaker. At 816, flow 800 either terminates or repeats.

Figure 9:
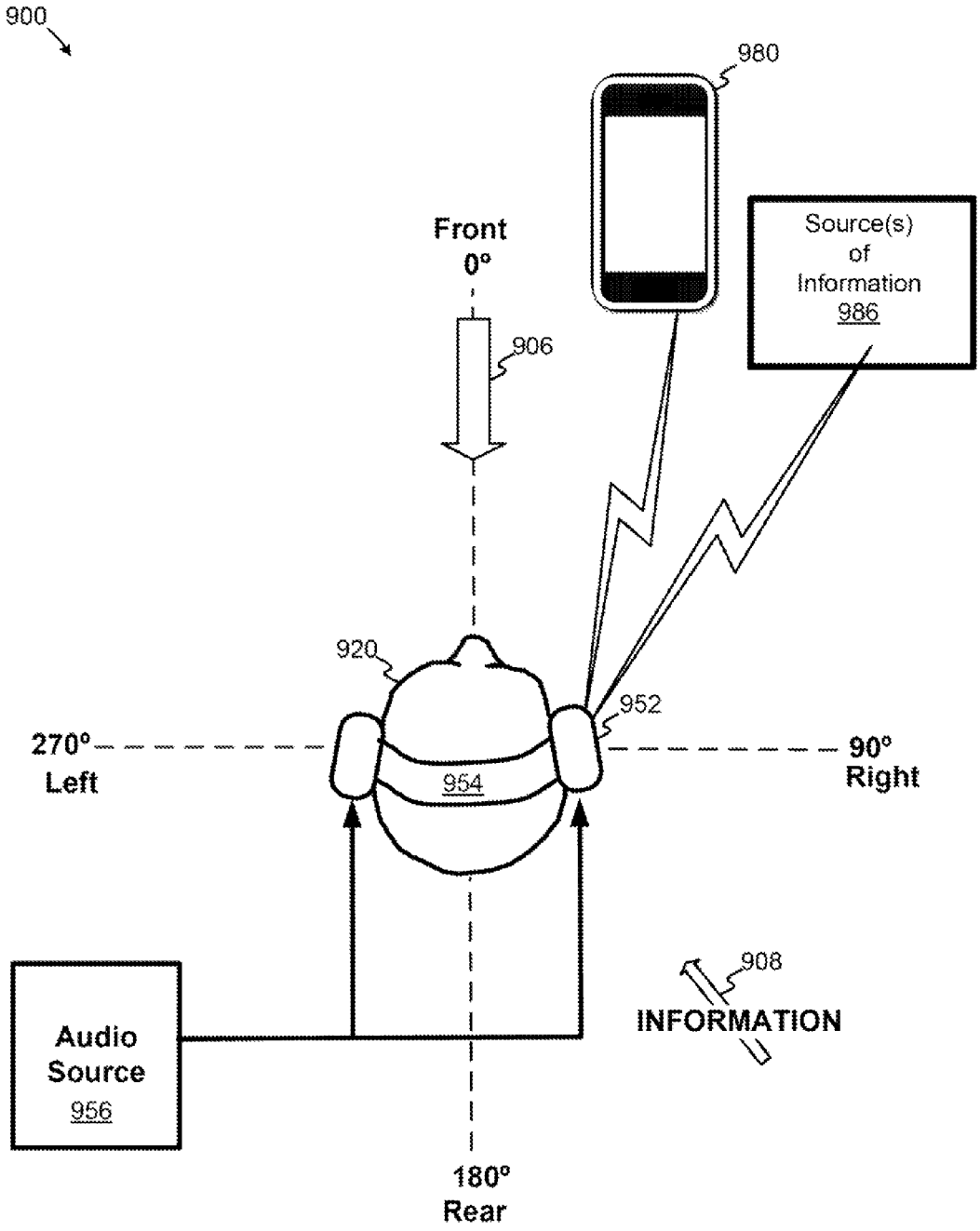
FIG. 9 depicts an example of mono-spatial messaging when a user is consuming other audio, according to some embodiments.

FIG. 9 depicts an example of mono-spatial messaging when a user is consuming other audio, according to some embodiments. Diagram 900 depicts a user 920 using an audio device 954, such as headphones, with which to receive audio into the user's ears, the audio originating from, for example, mobile computing device 980 or any other source of information 986. But in this example, user 920 can consume audio from audio source 956. In one instance, audio source 956 generates binaural audio. Regardless, a mono-spatial audio processor can be configured to provide mono-spatial messages 906 and 908 in relation to the user's ears 952. Therefore, while user 920 may be consuming audio in stereo, user 920 can receive mono-spatially modulated message audio for purposes of receiving critical and informational messages.

Figure 10:
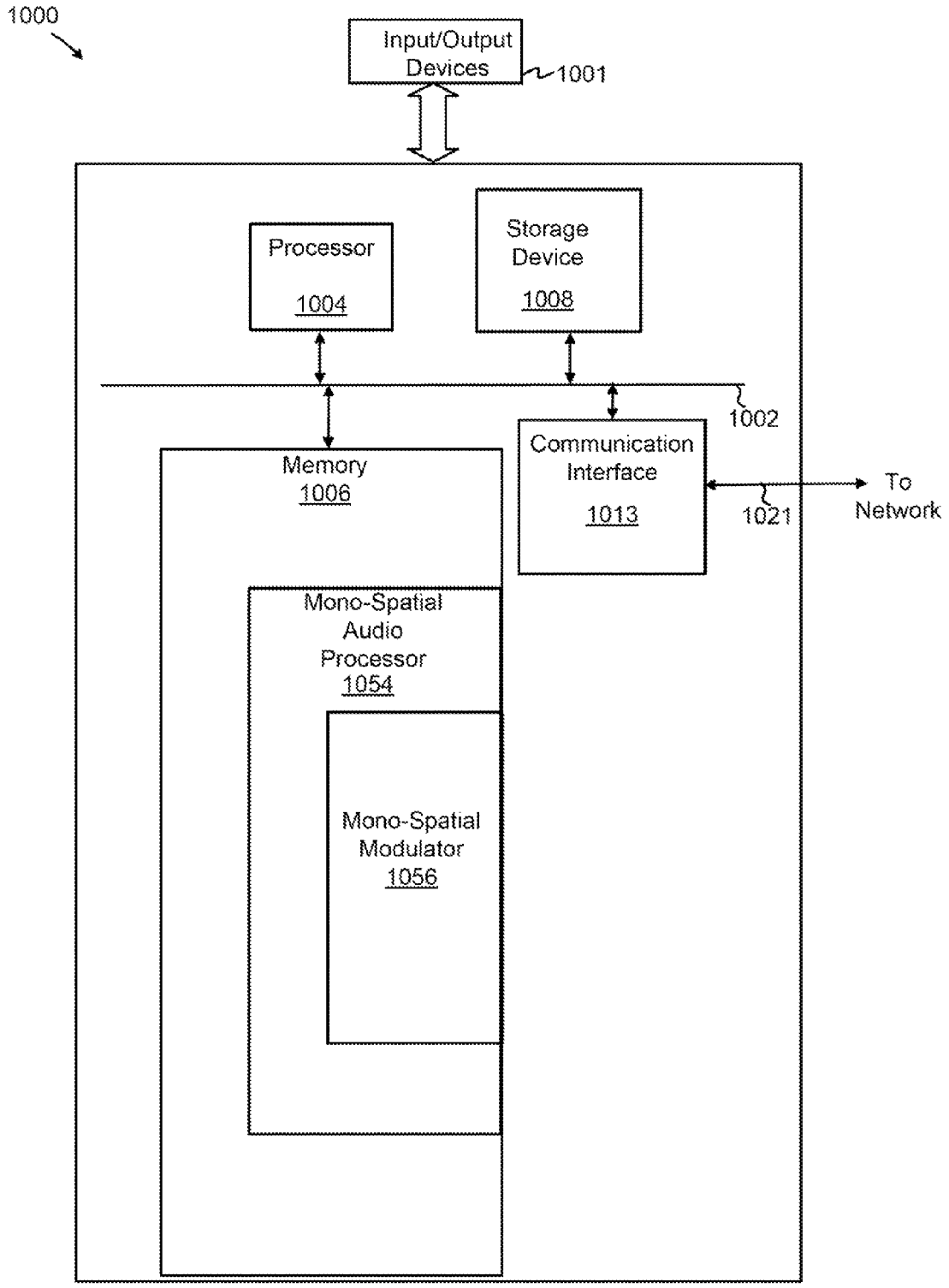
FIG. 10 illustrates an exemplary computing platform disposed in a computing or audio device in accordance with various embodiments.

FIG. 10 illustrates an exemplary computing platform disposed in a computing or audio device in accordance with various embodiments. In some examples, computing platform 1000 may be used to implement computer programs, applications, methods, processes, algorithms, or other software to perform the above-described techniques. Computing platform 1000 includes a bus 1002 or other communication mechanism for communicating information, which interconnects subsystems and devices, such as processor 1004, system memory 1006 (e.g., RAM, etc.), storage device 10010 (e.g., ROM, etc.), a communication interface 1013 (e.g., an Ethernet or wireless controller, a Bluetooth controller, etc.) to facilitate communications via a port on communication link 1021 to communicate, for example, with a computing device, including mobile computing and/or communication devices with processors. Processor 1004 can be implemented with one or more central processing units ("CPUs"), such as those manufactured by Intel® Corporation, or one or more virtual processors, as well as any combination of CPUs and virtual processors. Computing platform 1000 exchanges data representing inputs and outputs via input-and-output devices 1001, including, but not limited to, keyboards, mice, audio inputs (e.g., speech-to-text devices), user interfaces, displays, monitors, cursors, touch-sensitive displays, LCD or LED displays, and other I/O-related devices.

According to some examples, computing platform 1000 performs specific operations by processor 1004 executing one or more sequences of one or more instructions stored in system memory 1006, and computing platform 1000 can be implemented in a client-server arrangement, peer-to-peer arrangement, or as any mobile computing device, including smart phones and the like. Such instructions or data may be read into system memory 1006 from another computer readable medium, such as storage device 1008. In some examples, hard-wired circuitry may be used in place of or in combination with software instructions for implementation. Instructions may be embedded in software or firmware. The term "computer readable medium" refers to any tangible medium that participates in providing instructions to processor 1004 for execution. Such a medium may take many forms, including but not limited to, non-volatile media and volatile media. Non-volatile media includes, for example, optical or magnetic disks and the like. Volatile media includes dynamic memory, such as system memory 1006.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 1002 for transmitting a computer data signal.

In some examples, execution of the sequences of instructions may be performed by computing platform 1000. According to some examples, computing platform 1000 can be coupled by communication link 1021 (e.g., a wired network, such as LAN, PSTN, or any wireless network) to any other processor to perform the sequence of instructions in coordination with (or asynchronous to) one another. Computing platform 1000 may transmit and receive messages, data, and instructions, including program code (e.g., application code) through communication link 1021 and communication interface 1013. Received program code may be executed by processor 1004 as it is received, and/or stored in memory 1006 or other non-volatile storage for later execution.

In the example shown, system memory 1006 can include various modules that include executable instructions to implement functionalities described herein. In the example shown, system memory 1006 includes a mono-spatial audio processor module 1054, which can include a mono-spatial modulator module 1056, any of which can be configured to provide one or more functions described herein.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques. As hardware and/or firmware, the above-described techniques may be implemented using various types of programming or integrated circuit design languages, including hardware description languages, such as any register transfer language ("RTL") configured to design field-programmable gate arrays ("FPGAs"), application-specific integrated circuits ("ASICs"), or any other type of integrated circuit. According to some embodiments, the term "module" can refer, for example, to an algorithm or a portion thereof, and/or logic implemented in either hardware circuitry or software, or a combination thereof. These can be varied and are not limited to the examples or descriptions provided.

In some embodiments, a mono-spatial audio processor can be in communication (e.g., wired or wirelessly) with a mobile device, such as a mobile phone or computing device, or can be disposed therein. In some cases, a mobile device, or any networked computing device (not shown) in communication with a mono-spatial audio processor, can provide at least some of the structures and/or functions of any of the features described herein. As depicted in FIG. 1 and subsequent figures, the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in FIGS. 1, 6, and 7 (or any other figure) can represent one or more algorithms. Or, at least one of the elements can represent a portion of logic including a portion of hardware configured to provide constituent structures and/or functionalities.

For example, a mono-spatial audio processor and any of its one or more components can be implemented in one or more computing devices (i.e., any mobile computing device, such as a wearable device, an audio device (such as headphones or a headset) or mobile phone, whether worn or carried) that include one or more processors configured to execute one or more algorithms in memory. Thus, at least some of the elements in FIG. 1 (or any subsequent figure) can represent one or more algorithms. Or, at least one of the elements can represent a portion of logic including a portion of hardware configured to provide constituent structures and/or functionalities. These can be varied and are not limited to the examples or descriptions provided.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, a mono-spatial audio processor, including one or more components, can be implemented in one or more computing devices that include one or more circuits. Thus, at least one of the elements in FIG. 1 (or any subsequent figure) can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed:

1. A method comprising:

receiving data representing a message to present acoustically at a loudspeaker;

determining whether an audio signal is in communication with the loudspeaker, including determining no audio signal is in communication with the loudspeaker, and generating a reference audio signal;

determining a type of the message associated with the message;

modulating spatially a message audio signal for the message as a function of the type of message to form a spatially-modulated message audio signal;

forming a mono-spatial audio signal based on the audio signal and the spatially-modulated message; and audio signal, a mono-spatial audio space overlay being used to form the mono-spatial audio signal after the mono-spatial audio space overlay is generated and configured to simulate an originating location, direction, or distance associated with the mono-spatial audio signal; and transmitting the mono-spatial audio signal to the loudspeaker.

2. The method of claim 1, wherein transmitting the mono-spatial audio signal to the loudspeaker comprises:

generating a monaural signal as the mono-spatial audio signal; and transmitting the monaural signal to the loudspeaker.

3. The method of claim 1, wherein modulating spatially the message audio signal for the message as the function of the type of message comprises: generating a monaural signal configured to acoustically interact with a space to form a spatial environment in which a user perceives an origination of a source of a portion of the monaural signal associated with the spatially-modulated message audio signal at different locations.

4. The method of claim 3, wherein the space comprises: an ear canal.

5. The method of claim 3, wherein generating the monaural signal comprises:

generating a white noise signal as the audio signal.

6. The method of claim 1, wherein modulating spatially the message audio signal comprises:

determining a subset of modulation parameters for the type of message; and shifting either a phase or a frequency, or both, of the message audio signal based on the subset of modulation parameters to form the spatially-modulated message audio signal.

7. The method of claim 6, wherein the subset of modulation parameters comprises:

data based on a data model of an ear canal.

8. The method of claim 6, further comprising:

determining a subset of the modulation parameters for the type of message associated with an amplitude; and modulating the volume of the message audio signal based on the subset of the modulation parameters.

9. The method of claim 1, wherein determining the type of the message comprises:

identifying a primary message type associated with the message; and selecting a first subset of modulation parameters configured to form the spatially-modulated message audio signal associated with a first direction.

10. The method of claim 9, wherein selecting the first subset of modulation parameters comprises:

selecting modulation parameters configured to simulate origination of the first direction between 0 degrees and 90 degrees relative to a reference point.

11. The method of claim 1, wherein determining the type of the message comprises:

identifying a secondary message type associated with the message; and selecting a second subset of modulation parameters configured to form the spatially-modulated message audio signal associated with a second direction.

12. The method of claim 11, wherein selecting the second subset of modulation parameters comprises:

selecting modulation parameters configured to simulate origination of the second direction between 90 degrees and 180 degrees relative to a reference point.

13. The method of claim 1, wherein determining the type of the message comprises:

identifying an alert message type associated with the message; and selecting a third subset of modulation parameters configured to form the spatially-modulated message audio signal associated with multiple directions over an interval of time.

14. An apparatus comprising:

a terminal at which an audio signal is received;

a reference signal generator configured to generate a reference signal as the audio signal;

a processor configured to execute instructions to implement a mono-spatial modulator configured to:

determine a type of a message associated with the message;

modulate spatially a message audio signal for the message as a function of the type of message to form a spatially-modulated message audio signal;

form a modulated audio signal based on the audio signal and the spatially-modulated message audio signal, a mono-spatial audio space overlay being used to form the mono-spatial audio signal after the mono-spatial space overlay is generated and configured to simulate an originating location, direction, or distance associated with the mono-spatial audio signal; and transmitting the modulated audio signal to a loudspeaker.

15. The apparatus of claim 14, wherein the processor is further configured to execute instructions to:

generate the modulated audio signal as a mono-spatially modulated audio signal; and transmit the mono-spatially modulated audio signal to the loudspeaker, wherein the modulated audio signal is a monaural signal.

16. The apparatus of claim 14, wherein the processor is further configured to execute instructions to:

determine no audio signal is in communication with the loudspeaker;

generate a reference audio signal as the audio signal.

17. The apparatus of claim 14, wherein the processor is further configured to execute instructions to:

determine a subset of modulation parameters for the type of message; and shift either a phase or a frequency, or both, of the message audio signal based on the subset of modulation parameters to form the spatially-modulated message audio signal.

18. The apparatus of claim 17, wherein the type of message is one of a primary message, a secondary message, and an alert message.

* * * * *